US010610918B2

(12) United States Patent
Oberholzer

(10) Patent No.: US 10,610,918 B2
(45) Date of Patent: Apr. 7, 2020

(54) METHOD AND DEVICE FOR THE MANUFACTURE OF A CAN WITH A TEAR-OPEN LID AND CAN WITH A TEAR-OPEN LID

(71) Applicant: Soudronic AG, Bergdietikon (CH)

(72) Inventor: Marcel Oberholzer, Bergdietikon (CH)

(73) Assignee: SOUDRONIC AG, Bergdietikon (CH)

( * ) Notice: Subject to any disclaimer, the term of this patent is extended or adjusted under 35 U.S.C. 154(b) by 427 days.

(21) Appl. No.: 15/666,027

(22) Filed: Aug. 1, 2017

(65) Prior Publication Data

US 2017/0327268 A1 Nov. 16, 2017

Related U.S. Application Data

(62) Division of application No. 14/372,633, filed as application No. PCT/CH2013/000007 on Jan. 14, 2013, now Pat. No. 9,776,761.

(30) Foreign Application Priority Data

Jan. 18, 2012 (CH) ..... 81/12

(51) Int. Cl.
*B21D 51/26* (2006.01)
*B21D 51/44* (2006.01)
(Continued)

(52) U.S. Cl.
CPC ..... *B21D 51/2653* (2013.01); *B21D 51/443* (2013.01); *B65D 17/4011* (2018.01); *B65D 17/502* (2013.01); *B65D 2517/0041* (2013.01)

(58) Field of Classification Search
CPC ..... B65D 17/4011; B65D 17/502; B65D 17/402; B65D 51/20; B65D 51/18;
(Continued)

(56) References Cited

U.S. PATENT DOCUMENTS 594,130 A * 11/1897 Burnett ..... B65D 51/20 220/258.3
1,484,195 A * 2/1924 Sexton ..... B65D 51/20 220/258.3

(Continued)

FOREIGN PATENT DOCUMENTS

DE 4416161 A1 11/1994
DE 9117216 U1 6/1997

(Continued)

OTHER PUBLICATIONS

Translation of DE4416161A1, Mulleder, Nov. 17, 1994, Paragraph 9 (Year: 1994).*
International search report for PCT/CH2013/000007 dated Mar. 6, 2013.

*Primary Examiner* — Robert J Hicks
(74) *Attorney, Agent, or Firm* — McCormick, Paulding & Huber PLLC

(57) ABSTRACT

To manufacture a metal can having a tear-open lid and having a storage space for an object above the tear-open lid, the following procedure is used: first, a top edge of the can which has a smaller diameter than the inside diameter of the can body is formed, wherein a transition region (6) is formed. After the tear-open lid has been attached, this transition region is deep drawn so that the tear-open lid (2) is displaced towards the bottom (5) of the can. This produces the storage space. This procedure allows previously formed tear-open lids to be used, which safely guarantees the imperviousness of the seal of the tear-open lid.

7 Claims, 9 Drawing Sheets

(51) Int. Cl.
*B65D 17/50* (2006.01)
*B65D 17/40* (2006.01)
*B65D 17/28* (2006.01)

(58) Field of Classification Search
CPC ... B65D 1/46; B65D 7/48; B65D 7/46; B65D 7/44; B21D 51/2653; B21D 51/443; B21D 51/38; B21D 51/44; B21D 51/383
USPC ..... 220/315, 319, 270, 266, 265, 254.7, 220/254.1, 258.2, 258.3, 258.1, 256.1, 220/212, 657, 604, 623, 608, 658, 643; 413/14, 12, 8, 25
See application file for complete search history.

(56) References Cited

U.S. PATENT DOCUMENTS

| | | | | | |
|---|---|---|---|---|---|
| 2,070,653 | A | | 2/1937 | Gibbs | |
| 3,204,810 | A | * | 9/1965 | Eckman | B65D 51/20 220/258.2 |
| 5,069,355 | A | * | 12/1991 | Matuszak | B65D 17/502 220/270 |

FOREIGN PATENT DOCUMENTS

| | | | | | |
|---|---|---|---|---|---|
| EP | 1559655 | A1 | | 8/2005 | |
| EP | 2062828 | A1 | | 5/2009 | |
| GB | 2369342 | A | | 5/2002 | |
| WO | 9637414 | A1 | | 11/1996 | |
| WO | WO-0110731 | A1 | * | 2/2001 | B65D 17/502 |
| WO | 0243895 | A1 | | 6/2002 | |
| WO | 2009065235 | A1 | | 5/2009 | |

* cited by examiner 4
5'
6
3
30
A
B
C
K
H
I
A-A
B-B
C-C
7

2
4
4
5'
2
6
31
4
25
D
D
E
E
L
M
D-D
E-E
2
7
6
4
L
7
6
4
M 13
4
5'

14
2
4
F
F
14
G
G
14
10
N
H
2
4
5'
5'
F-F
G-G
13
10
4
4
6
2
N
14
17
15
2
10
4
O

4

4
5'

7
6
3
4
5'

4

2
25
28
6
4
5'

2
13
10
6
4

14
4

METHOD AND DEVICE FOR THE MANUFACTURE OF A CAN WITH A TEAR-OPEN LID AND CAN WITH A TEAR-OPEN LID

CROSS REFERENCE TO RELATED APPLICATIONS

This application is a divisional of U.S. patent application Ser. No. 14/372,633, filed Jul. 16, 2014, which claims priority to International Patent Application No. PCT/CH2013/000007, filed on Jan. 14, 2013 and Swiss Patent Application No. 81/12 filed on Jan. 18, 2012.

BACKGROUND OF THE INVENTION

The invention relates to a method for the manufacture of a metal can having a tear-open lid and having a storage space for an object, which storage space is arranged above the tear-open lid and is bounded above the tear-open lid at the side by the sleeve of the can. Further, the invention relates to a can having a can body as well as a bottom and a tear-open lid, wherein the tear-open lid is formed by a tear-open lid ring with a tear-open foil attached thereto such that it can be torn off. Further, the invention relates to a device for the manufacture of a can having a tear-open lid.

PRIOR ART

It is known to design lids for can or tubular type containers in the form of tear-open lids which are permanently attached to the top of the container and which form a removal opening which is sealed by a tear-open foil until the package content is used for the first time. This can be a metal foil or composite foil for example. Here, the foil is applied to a metal tear-open lid ring by hot-sealing, and tear-open foil and lid ring together form the tear-open lid. The container body and the lid are joined together, in particular by means of a folded joint. An additional plastic lid arranged on the container above the tear-open lid makes the container resealable during the time for which its contents are being consumed.

During the manufacture of containers or cans with tear-open lids, it may be required to form a storage space between the tear-open lid and a resealable lid, in which a dosing spoon, for example, or some other object can be accommodated. With a can which is available on the market, this has previously been solved in that the sleeve of the can body is bent over and deep-drawn towards the bottom and directly forms the removal opening. A tear-open foil is sealed onto this deep-drawn edge formed by the can body. This requires special sealing tools and is not optimum from the point of view of the can body/sealing foil material pairing.

SUMMARY OF THE INVENTION

The object of the present invention is to create an improved manufacturing method for cans having tear-open lids and storage spaces.

This object is achieved with the method mentioned in the introduction in that

- a top edge of the can body is formed, the diameter of which is less than the inside diameter of the can body, wherein a transition region is formed between the can body and the top edge,

- a previously formed tear-open lid with a metal tear-open lid ring and a tear-open foil which is sealed on the tear-open lid ring is attached to the top edge, and that
- the transition region is reformed in such a way that the tear-open lid is displaced in the direction of the bottom of the can in order to create the storage space.

The method according to the invention has the great advantage that use is made of a conventionally made tear-open lid which has been manufactured on a production line for tear-open lids where the sealing or the imperviousness of the sealing of which can be easily controlled and tested. According to the present method, such a tear-open lid can also be used to form a can with storage space, enabling such a can to be manufactured easily and with imperviousness of the sealed joint which can be reproduced very reliably.

Preferably, the tear-open lid is attached to the top edge of the can body by means of a folded joint, which results in a joint between can body and tear-open lid which is well-known and can be reliably controlled during manufacture.

Preferably, the top edge is produced by a processing of the can body known as curling. Further, it is preferred that the tear-open lid is displaced by a multiple of the tear-open lid height in the direction of the bottom of the container or the bottom end of the can body, in particular by approx. 20 mm to 30 mm in this direction, by deep-drawing of the transition region. This enables a sufficiently large storage space to be created in a simple manner.

Further, it is preferred when a second lid is arranged on the container in a releasable and re-attachable manner by means of a circumferential bead running externally around the can body and a circumferential molding provided on the lid which can engage in the bead. Instead of a second lid, the can can also be encompassed entirely or partially by a film, e.g. a shrink film, which seals the top of the storage space until the film is opened, wherein the easy resealability by means of the second lid is then dispensed with. If an object is attached in the storage space between tear-open lid and the top boundary, e.g. by a releasable adhesive connection to the tear-open foil, then the top film could also be dispensed with so that the storage space is open on one side or at the top.

The method is particularly suitable for the formation of three-part cans in which the bottom of the can is a separate part which is likewise joined to the can body, in particular likewise by a folded joint.

The invention is also based on the object of creating a can with tear-open lid and storage space which is easy to manufacture and with which the imperviousness of the tear-open foil is guaranteed.

This is achieved with a can having a can body as well as a bottom and a tear-open lid, wherein the tear-open lid is formed by a tear-open lid ring with a tear-open foil attached thereto such that it can be torn off. The tear-open lid is offset with respect to the top boundary of the can towards the bottom of the can, thus a storage space is formed between tear-open lid and top boundary.

With such a can, a tear-open lid which is formed by a tear-open lid ring with a tear-open foil sealed thereon is provided. This results in the advantages which arise from a separate formation of such a tear-open lid on a production line for tear-open lids which is specialized for the purpose, in particular the imperviousness of the sealed joint which can be reliably reproduced and tested.

Further, the invention is based on the object of creating a device for the manufacture of cans having tear-open lids.

This object is achieved with a device for the manufacture of a can with a tear-open lid offset from the top boundary toward the can bottom, wherein the device has a tool for attaching a tear-open lid to the top edge of a can body. The device has a first reforming tool which is designed in such a way that the top edge of a can body can be reformed with said tool while forming a transition region in such a way that the diameter of the top edge is less than the inside diameter of the can body. The device has a tool for attaching a tear-open lid to the top edge, and a reforming tool which is designed in such a way that the transition region can be re-formed such that the tear-open lid which is attached to the top edge can be displaced in the direction of the bottom of the can.

This results in the advantages mentioned above for the method and for the can.

BRIEF DESCRIPTION OF THE DRAWINGS

Further advantageous embodiments of the invention can be seen from the exemplary embodiments described below with reference to the drawings. In the drawings.

DESCRIPTION OF PREFERRED EMBODIMENTS

Proportions shown in the figures are purely by way of example and are not to be construed as restrictive. In the figures, the same references designate structurally identical or functionally identically acting components. The geometry of the can and therefore of the tear-open lid and of a possible second lid is not restricted to round packaging bodies or cans; oval, rectangular or other forms are equally possible. Here, such forms are always included in the designation "can", "tear-open lid" and "tear-open lid ring". The term tear-open lid ring designates a metal ring-shaped carrier for a sealing foil. The can body is likewise made of metal.

FIGS. 1 to 8 show a known can having a tear-open lid or show tear-open lids and serve to explain manufacturing steps in the manufacture of known tear-open lids. The present invention uses a tear-open lid which has been previously produced in this or a similar manner and its manufacture is therefore explained here for the sake of completeness. However, this manufacturing method is not to be understood as being restrictive for the present invention. This assumes only that a tear-open lid with a tear-open lid ring and a tear-open foil sealed thereon is available.

Figure 2:
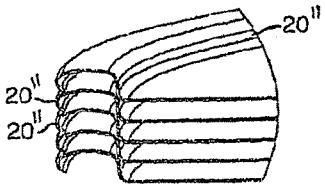
FIG. 2 Prior Art
FIGS. 2 to 8 show various stages of the manufacture of tear-open lids according to the prior art.
Figure 3:
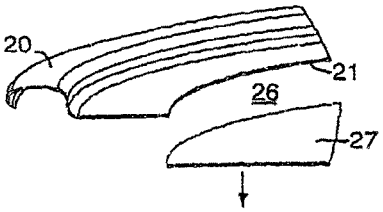
FIG. 3 Prior Art
Figure 4:
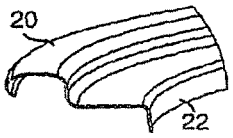
FIG. 4 Prior Art
Figure 5:
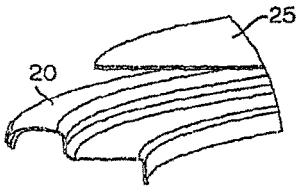
FIG. 5 Prior Art
Figure 6:
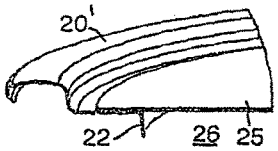
FIG. 6 Prior Art
Figure 7:
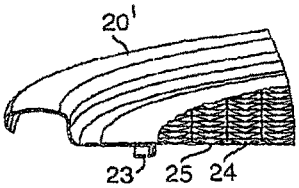
FIG. 7 Prior Art
Figure 8:
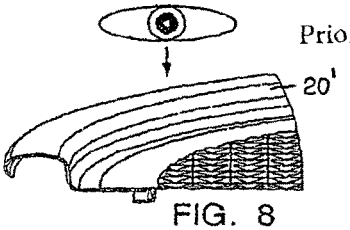
FIG. 8 Prior Art

As a rule, devices for the manufacture of metal lids with tear-open foil have a plurality of processing stations arranged linearly or rotatively on a machine frame, and a conveyor device which conveys the lid parts or lids from the beginning of the device, where pre-formed lid parts enter the device, to the end of the device, where the finished tear-open lids pass via chutes into storage boxes. FIG. 2 shows stacked metal lid blanks 20" as an example of lid parts. These blanks 20" are round metal discs, for example, of, for example, 11 cm diameter. As mentioned, other basic shapes, e.g. square, oval or rectangular discs and other diameters are easily possible. The blanks 20" have already been pre-formed at their edge in a known manner in a processing machine (not shown) as will be described in more detail later with reference to FIG. 9. This edge forming is suitable for a folded joint of tear-open lid and container body or can body, which is also the preferred joint for the present invention. In FIG. 2 and the following FIGS. 3 to 8, only one sector of the whole disc is shown in each case in order to simplify the drawing. In a first processing station, an opening 26 is stamped in the disc by means of a stamping operation with top and bottom tool, as can be seen in FIG. 3, in which the edge of the opening is designated by 21 and the stamped-out round disc by 27. Thus a lid ring has been made. In a next processing station, the edge 21 is drawn downwards, as a result of which the development 22 of the edge shown in FIG. 4 is achieved. The lid rings 20 now pass into a further processing station in which a foil 25 is placed over the opening 26 of the lid ring 20 where it is attached by hot-sealing as can be seen in FIGS. 5 and 6. The metal foil or composite foil 25 is provided on its underside with a plastic film in a known manner. The required foil blank 25 is usually stamped out of a wide foil strip and placed over the central cutout or lid opening of the ring-shaped disc and, by means of the hot-sealing station, the film is pressed under the action of heat against the edge of the round cutout of the lid ring 20 under the action of heat so that the foil 25 is closely bonded to the lid ring 20 by melting and subsequent cooling of the plastic film. By this step the tear-open lid 20' is provided. A cooling station can possibly be provided for cooling. In a further processing station, the foil 25 can be provided with an embossing 24 (FIG. 7) and, furthermore, the edge 22 is flanged to form the finished edge 23. In doing so, different flange forms can be provided. Other measures for protecting the cut edge can also be provided. The explained production of tear-open lids 20' is known to the person skilled in the art and does not have to be explained in more detail here.

Figure 1:
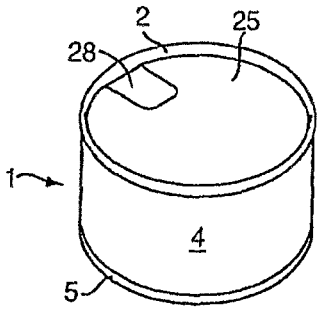
FIG. 1 Prior Art
FIG. 1 shows a perspective view of a conventional can with a tear-open lid but without storage space.
Figure 9:
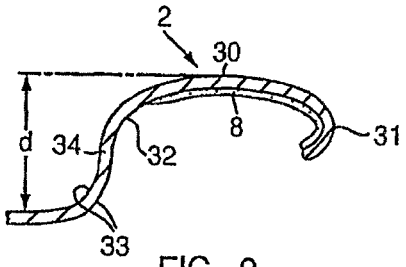
FIG. 9 Prior Art
FIG. 9 shows a view of the tear-open lid edge.
Figure 10:
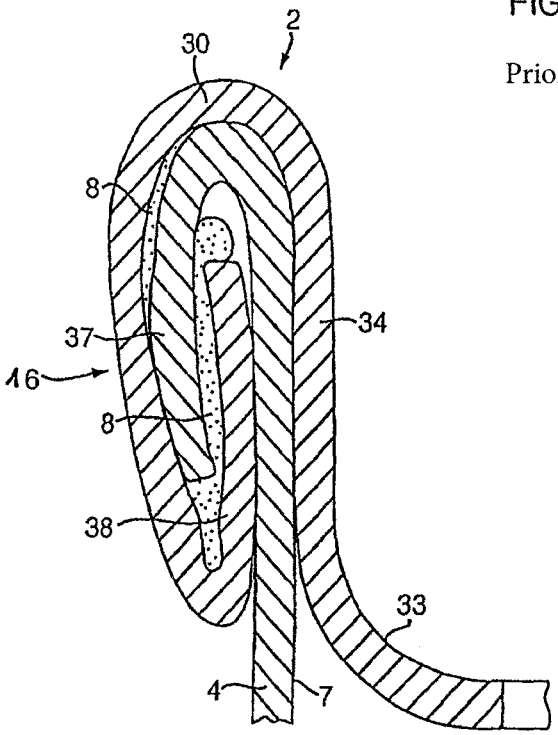
FIG. 10 Prior Art
FIG. 10 shows a view of a known folded joint between tear-open lid and the can body.

As an example to further explain the prior art, FIG. 1 shows a known three-part can 1 having, in this example, a cylindrical can body 4 and having a tear-open lid 2, in particular a tear-open lid as has previously been explained with reference to FIGS. 2 to 8, the lid opening of which is sealed by the tear-open foil 25. This foil 25 is provided with a tab 28 to tear the foil away from the lid ring. The can 1 further has a bottom lid or bottom 5 which, in particular, can be designed in the form of a metal bottom which is attached to the body by means of a fold. As previously mentioned with the prior art, a further lid—not shown here—can be provided above the tear-open lid. Within the framework of the present invention, the tear-open lid 2 can be attached to the container or can in any known manner. This applies as well to bottom 5. However, it is preferred that a known folded joint of tear-open lid and can body is used with the present invention and this applies as well to bottom 5 which is later attached to the can body. FIGS. 9 and 10 serve here to explain a known folded joint such as can also be used in the present invention. At the same time, FIG. 9 shows the design of the tear-open lid edge for the folded joint on the can side, and FIG. 10 shows a corresponding detail view of a folded joint of tear-open lid and can body 4 as is known to the person skilled in the art.

Only part of the tear-open lid 2 can be seen in the cross-section in FIG. 9. As in FIGS. 2-8, this embodiment of the lid has a seaming panel 30 which is provided with a curl 31 on the outside of the lid. A lining compound 8 is preferably provided on the inside of the seaming panel. Facing the removable opening (not shown) with the tear-open foil, the lid 2 has a seaming panel radius 32 with which the seaming panel merges with the chuck wall 34, which chuck wall is followed by the chuck wall radius 33. Together with the chuck wall, the stated radii result in the countersink depth d. When mention is made of the "height" of the tear-open lid below, then this dimension d is meant. If such a lid 2 is joined by folding to the can body 4, which is provided with a flange on the tear-open lid side, then this results in the folded joint 16 according to FIG. 10. The folded joint is produced in a manner known to the person skilled in the art in that a sealing head engages in the tear-open lid and tools successively undertake the folding with different rollers on the outside. With the present invention, this can take place in this known manner. The finished joint according to FIG. 10, in which the same references designate the same elements as in FIG. 9, is effected in that a folded body hook 37 is engaged with the end hook 38. This results in a stable joint between the tear-open lid 2 and the body 4, wherein the chuck wall can rest on the inside 7 of the body as shown. The lining compound 8 mentioned seals the folded joint. Within the framework of the present invention, such a folded joint which is known to the person skilled in the art, or also a similarly designed folded joint which is known to the person skilled in the art, is the preferred joint between tear-open lid and can body and as well between bottom lid and can body of the three part can. However, the top edge of the can body is first reduced in diameter, as will be explained below, which however has no effect on the design of the folded joint as such.

Figures 11, 12, 13:
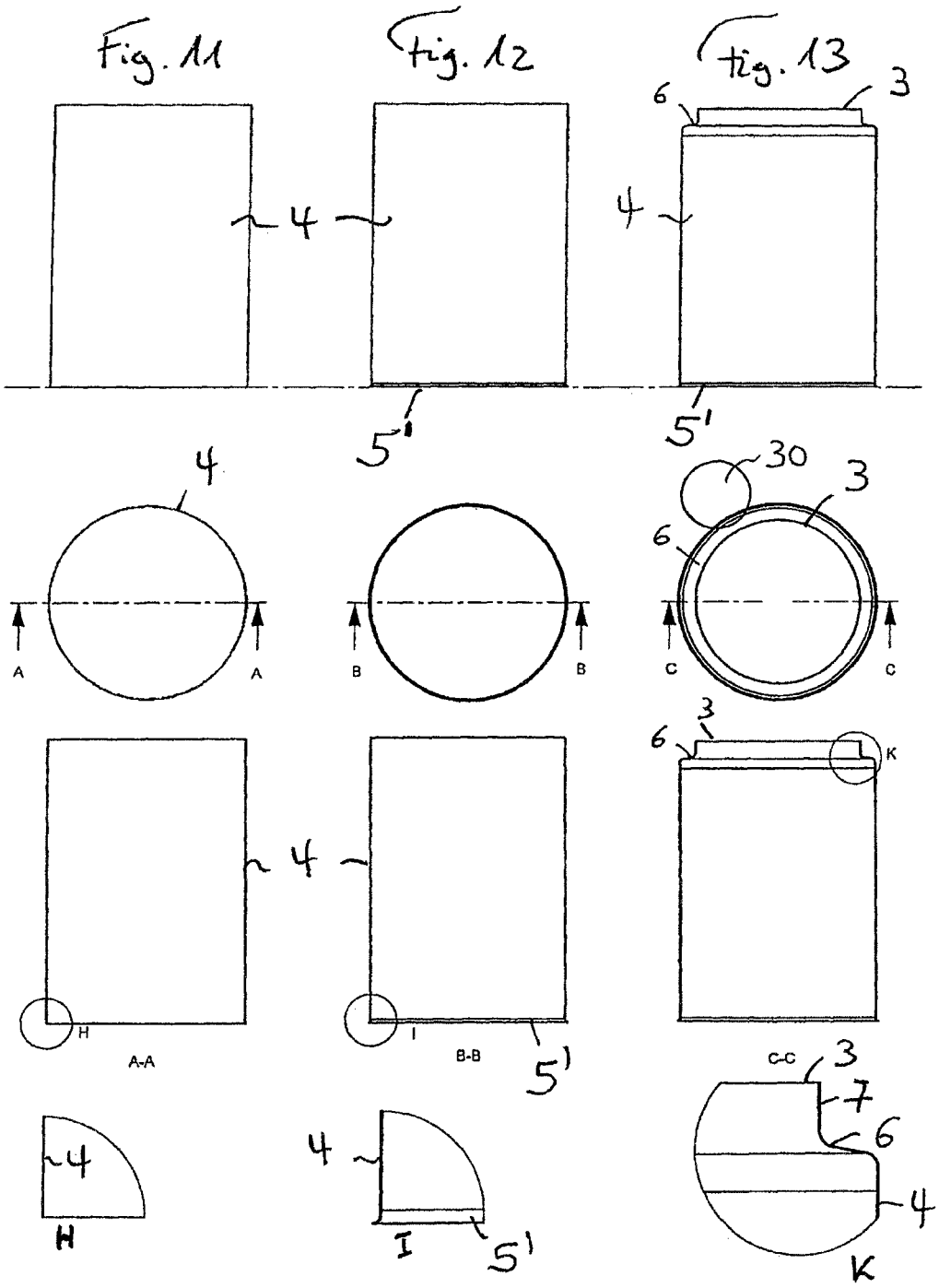
FIGS. 11 to 17 show manufacturing steps of the can according to an exemplary embodiment of the invention to explain the method, wherein each figure shows a side view of part of the can or of the can, a plan view from above, a sectional view and a detail.

FIGS. 11 to 17 and 18 to 24 now show an exemplary embodiment of the present invention. FIG. 11 shows the can body 4 of the can, wherein a side view is shown at the top of the drawing, beneath this a view from above with a section line (here section line A-A), beneath this the corresponding section and beneath this a detail (here detail H). This type of representation is also chosen for the other FIGS. 12 to 17. FIGS. 18 to 24 correspondingly show a diagrammatic view of the can body 4 and the can, respectively. The can body has been formed in a known manner which is the state of the art for the production of cans and does not have to be explained in more detail here.

Figures 18, 19, 20, 21:
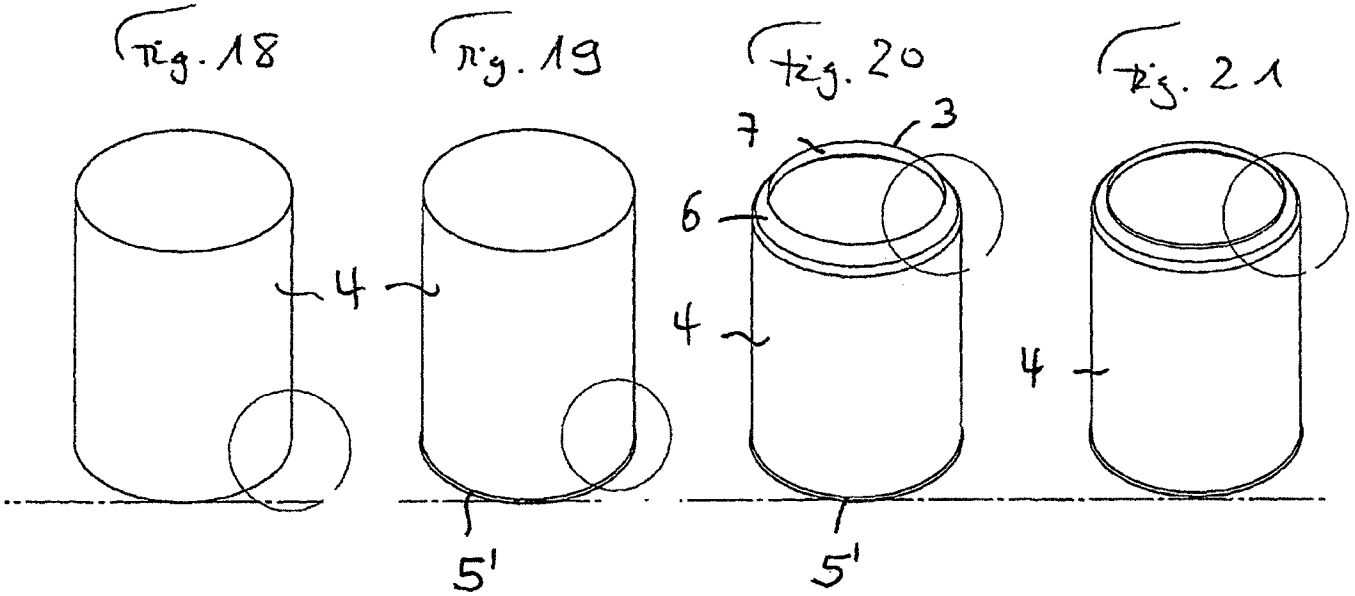
FIGS. 18 to 24 each show a diagrammatic view and a diagrammatic detail view corresponding to FIGS. 11 to 17.

FIG. 12 shows a preferred embodiment in which the can body has been curled at its bottom end 5', thus resulting in the outwardly bent form of the bottom end 5' of the can body 4 which lends the can body increased stability. The sectional view according to the section line B-B and the detail I of the outwardly bent end 5' of the can body 4 can be seen. As known, the bottom lid 5 of the container is not fitted until later after the container or can has been filled with its contents in the filling machine. Preferably, the bottom lid 5 is attached by means of a folded joint, e.g. a folded joint according to FIG. 10 or a similarly designed folded joint. At the same time, the bottom is a (in this case round) metal lid. The corresponding diagrammatic view of the can body with the curled end is shown in FIG. 19.

FIG. 13 shows a first step which differentiates the present invention from the prior art. The top part of the can body is reformed resulting in a top edge 7 of the can body 4 with the face side 3, the diameter of which is less than the inside diameter of the unreformed can body. At the same time, a transition region 6 is produced between the unreformed can body 4 and the edge 7. This can be easily seen in the side view and in the sectional view (section line C-C) and particularly in detail K and in the diagrammatic view of FIG. 20. The top edge 7 can be reformed or drawn in by curling with a curling tool which is schematically shown by 30 in FIG. 13. Such tools are known to the person skilled in the art.

Figures 14, 15:
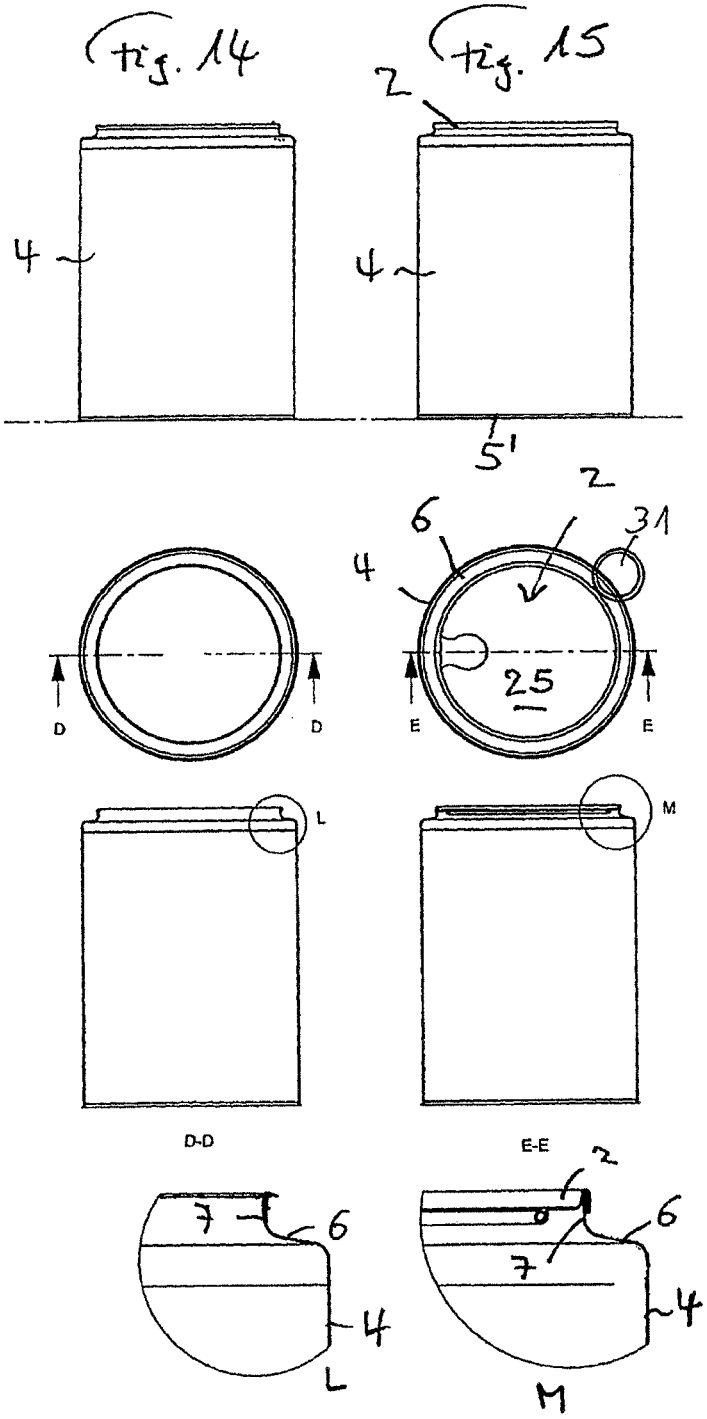

FIG. 14 shows that a flange has been formed at the top edge 7 in the manner known to the person skilled in the art. The flange is used for the subsequent folded joint between a tear-open lid and the can body. At the same time, the body hook 37, see FIG. 10, is produced during the folding operation. FIG. 21 shows the flange in a diagrammatic representation.

FIG. 15 shows that the tear-open lid 2 has been attached to the can body 4. In this case, this has been carried out using a folded joint, which is preferred, and reference can be made to FIG. 10 and the associated description for the explanation of a folded joint. With the present invention, the tools which are known for the purpose are used. A known folding tool for making the folded joint is schematically shown by 31. The diameter of the tear-open lid is of course chosen according to the reduced diameter of the top edge of the can body 4 and is therefore chosen to be less than the diameter of the bottom lid 5 of the finished container. This can also be easily seen from the diagrammatic representation of FIG. 22.

Figures 16, 17:
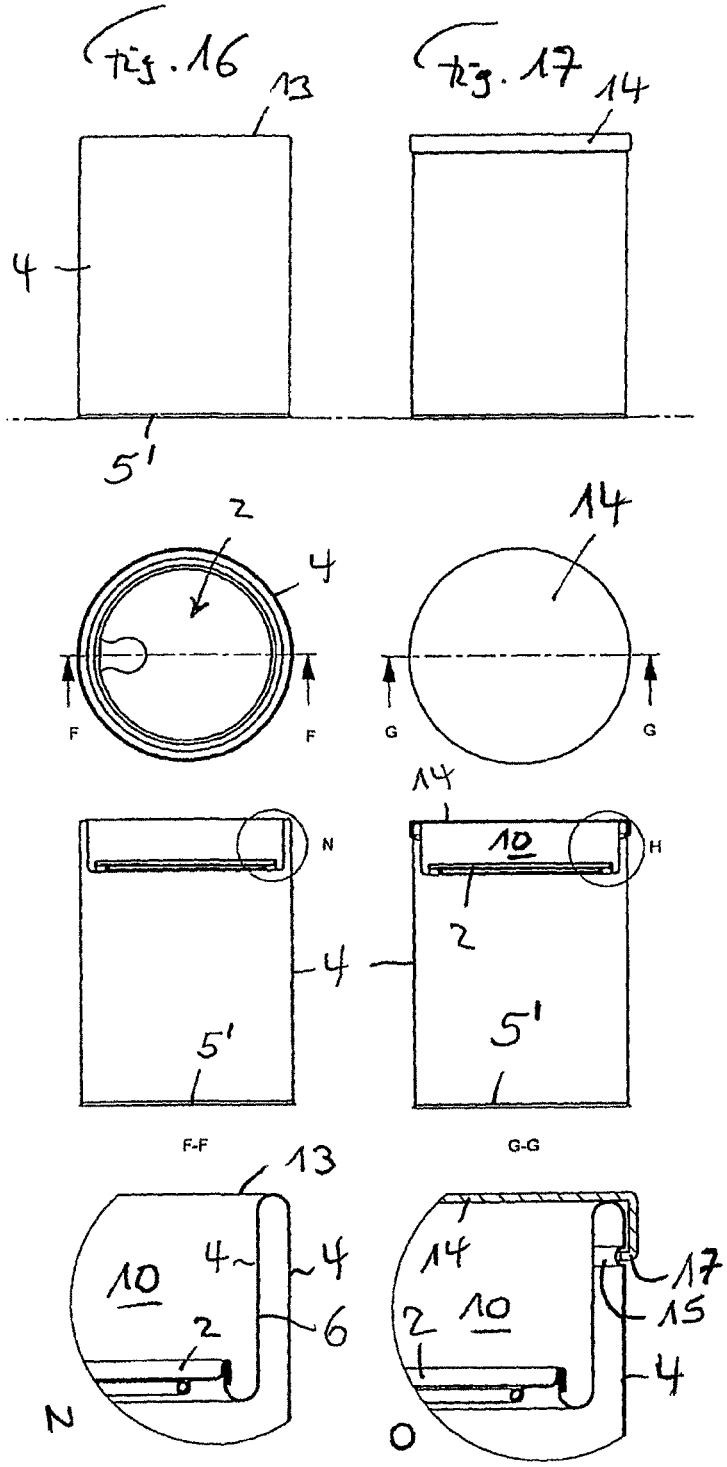
Figures 22, 23, 24:
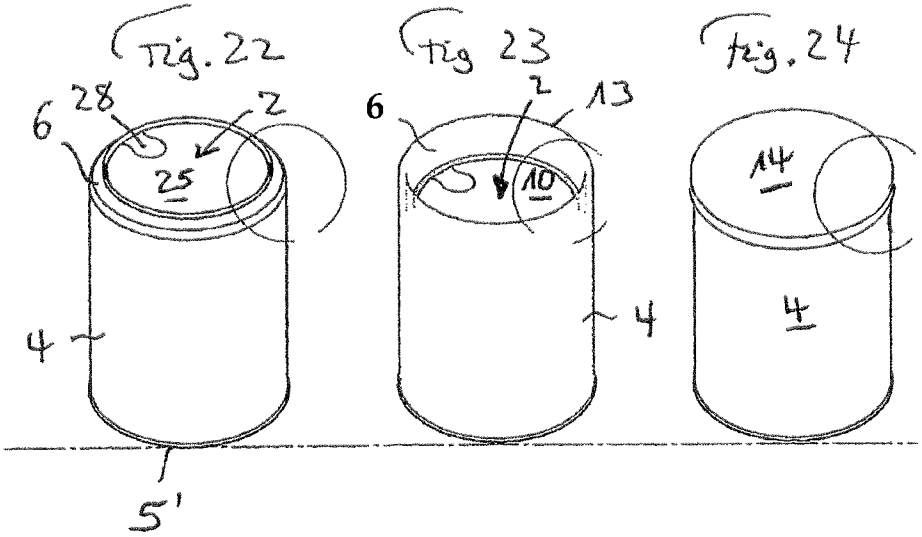
Figure 25:
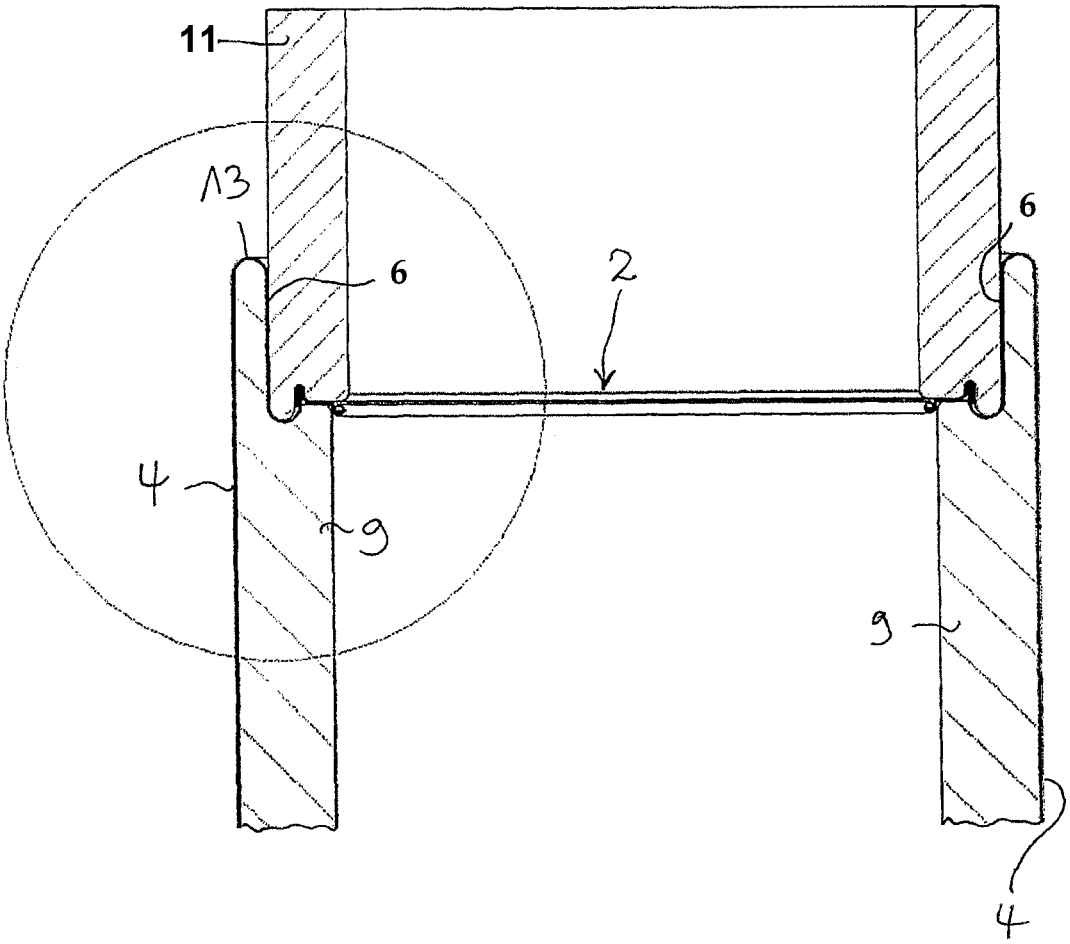
FIG. 25 shows a sectional view of the can body with tear-open lid during the deep-drawing process.
Figure 26:
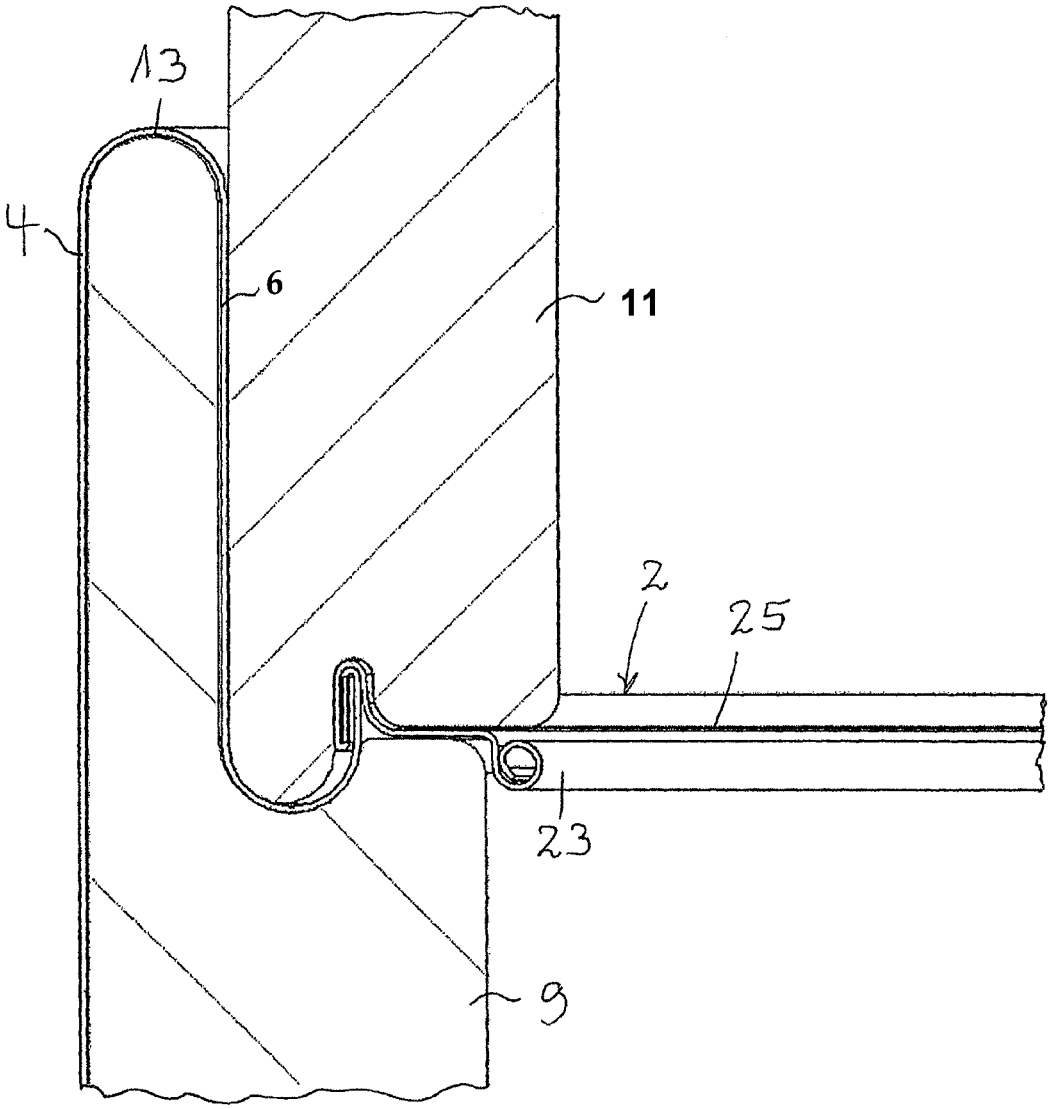
FIG. 26 shows a detail view of FIG. 25.

FIG. 16 shows the state which results after the further reforming step in which the transition region 6 has been reformed in such a way that the tear-open lid 6 has been displaced towards the bottom end 5' of the can body 4. This is carried out by means of a deep-drawing process which is known to the person skilled in the art. The ring-shaped deep-drawing tools, which are used for the purpose and which can be moved against one another (and apart again for ejection) by means of a tool drive (not shown) in order to displace the tear-open lid downwards, are shown in FIGS. 25 and 26. The transition region 6 is reformed by means of the deep-drawing tool so that it assumes the shape shown in FIG. 16 and, in particular, in the detail N thereof, thus forming a storage area 10, which is formed at the bottom by the tear-open lid 2 and at the side by the reformed part of the transition region 6 and is therefore directly bounded by the can body 4. The top boundary of the can is designated by 13 and, with these cans according to the invention, is formed by the can body 4 itself and not, as in conventional cans, by the tear-open lid as with the conventional can 1 according to FIGS. 1 and 10. A dosing spoon, for example, or some other object can be arranged in the storage area 10. FIG. 23 shows the can with the storage area in diagrammatic form. The degree of reforming by deep-drawing depends, on the one hand, on the required size or depth of the storage area and, on the other, the ability of the transition region to be deep drawn. In doing so, the tear-open lid can be displaced by a multiple of the height of the tear-open lid (or the dimension d in FIG. 9) and, in particular, the tear-open lid is displaced downwards by approx. 20 mm to 30 mm during the deep-drawing process.

This enables the method or the formation of the can to be completed. This notably when the object which is to be arranged in the storage area is attached to the tear-open lid by gluing, for example, or when the can is wrapped in a film, e.g. a shrink film, so that, as a result of these measures, the object is retained sufficiently safely in the storage area during transportation and storage. However, this results in the can not being resealable after it has been opened by tearing open the tear-open lid. It is therefore preferred that a second lid 14 made of plastic is provided as shown in FIG.

17 and in FIG. 24. Preferably, the second lid is attached to the can 4 in such a way that a bead 15 is formed or rolled in the can body, thus enabling a ring-shaped molding 17 on the lid 14 to engage in the bead. This provides a secure retention of the second lid 14.

FIGS. 25 and 26 show the completion of the step of deep-drawing the transition region 6 and therefore the completion of the downwards movement of the tear-open lid already attached to the can body towards the open end of the can body. The deep-drawing step is carried out with mutually corresponding positive and negative tool parts which can be moved against one another by a drive which is not shown. In particular, the drive can be by means of an electric motor or pneumatic or hydraulic. The bottom tool 9, which is fed into the can body from below, and the top tool 11, which engages with the can body from the outside, can be seen in FIGS. 25 and 26. At the same time, the detail view of FIG. 26 shows how the transition region 6 has been formed, wherein the tear-open lid, which has previously been attached to the top edge of the can body, has been displaced downwards.

The invention claimed is:

1. A can having a can body as well as a bottom and a tear-open lid, wherein the tear-open lid is formed by a tear-open lid ring with a tear-open foil attached thereto such that it can be torn off, characterized in that the tear-open lid is offset with respect to a top boundary of the can towards the bottom of the can, thus forming a storage space between the tear-open lid and the top boundary; the can body has a circumferential bead on the outside of the can body near the top boundary, the bead forms a recess in the wall of the can body, and another lid is provided, the other lid having a circumferential molding forming an inward projection that engages the recess in the wall of the can body for closure of the can body at the top boundary.

2. The can as claimed in claim 1, characterized in that the tear-open lid is attached to the can body by means of a folded joint.

3. The can as claimed in claim 2, characterized in that the tear-open lid is displaced with respect to the top boundary of the container towards the bottom of the container by approx. 20 mm to 30 mm.

4. The can as claimed in claim 2, characterized in that the can is formed as a three-part can with a separate bottom attached to the can body.

5. The can as claimed in claim 1, characterized in that the tear-open lid is displaced with respect to the top boundary of the container towards the bottom of the container by approx. 20 mm to 30 mm.

6. The can as claimed in claim 1, characterized in that the can is formed as a three-part can with a separate bottom attached to the can body.

7. The can as claimed in claim 1 characterized in that the storage space is laterally confined by the can body and that an upper edge of the can is provided by the can body.

* * * * *